US009540959B2

(12) United States Patent
Freund et al.

(10) Patent No.: US 9,540,959 B2
(45) Date of Patent: Jan. 10, 2017

(54) SYSTEM AND METHOD FOR GENERATING ELECTRIC POWER

(71) Applicant: General Electric Company, Schenectady, NY (US)

(72) Inventors: Sebastian Walter Freund, Unterfoehring (DE); Matthew Alexander Lehar, Munich (DE); William Joseph Antel, Jr., Freising (DE); Pierre Sébastien Huck, Munich (DE); Hannes Christopher Buck, Munich (DE); Trevor James Kirsten, Haimhausen (DE); Kenneth William Kohl, Greenfield, NY (US); Matthew Michael Lampo, Ballston Lake, NY (US); Charles Michael Jones, Ballston Lake, NY (US); Amit Gaikwad, Bangalore (IN); Lars Olof Nord, Trondheim (NO)

(73) Assignee: General Electric Company, Niskayuna, NY (US)

( * ) Notice: Subject to any disclaimer, the term of this patent is extended or adjusted under 35 U.S.C. 154(b) by 1082 days.

(21) Appl. No.: 13/660,536

(22) Filed: Oct. 25, 2012

(65) Prior Publication Data

US 2014/0117670 A1 May 1, 2014

(51) Int. Cl.
*F01D 15/10* (2006.01)
*F01K 13/02* (2006.01)
(Continued)

(52) U.S. Cl.
CPC ..... *F01K 13/02* (2013.01); *F01K 3/26* (2013.01); *F01K 7/44* (2013.01); *F01K 17/00* (2013.01);
(Continued)

(58) Field of Classification Search
CPC ... F01K 3/26–3/265; F01K 7/44; F01K 17/00; F01K 19/10; F01K 21/00; F04B 19/24; F04B 37/06
(Continued)

(56) References Cited

U.S. PATENT DOCUMENTS 5,216,899 A 6/1993 Fabris
5,685,152 A * 11/1997 Sterling ..... B60R 16/03 60/641.15
(Continued)

FOREIGN PATENT DOCUMENTS

EP 2400117 A1 12/2011
WO 2012057848 A1 5/2012

*Primary Examiner* — Thomas Denion
*Assistant Examiner* — Mickey France
(74) *Attorney, Agent, or Firm* — Ann M. Agosti

(57) ABSTRACT

A system and method for generating electric power using a generator coupled to a turboexpander is disclosed. The system includes one or more thermal pumps configured for heating a fluid to generate a pressurized gas. A portion of the pressurized gas is discharged to a buffer chamber for further utilization in a Rankine system. A further portion of the pressurized gas is expanded in a turboexpander for driving a generator for generating electric power. Optionally, the system includes a pump to pressurize a portion of the fluid depending on the systems operating condition. The system further includes one or more sensors for sensing temperature and pressure and outputs one or more signals representative of the sensed state. The system includes a control unit for receiving the signals and outputs one or more control signals for controlling the flow of gases and liquid in the valves and the check valve.

25 Claims, 5 Drawing Sheets

(51) Int. Cl.

| | |
|---|---|
| ***F04B 19/24*** | (2006.01) |
| ***F04F 1/04*** | (2006.01) |
| ***F01K 21/00*** | (2006.01) |
| ***F01K 7/44*** | (2006.01) |
| ***F01K 17/00*** | (2006.01) |
| ***F01K 3/26*** | (2006.01) |

(52) U.S. Cl.
CPC ..... *F01K 21/00* (2013.01); *F04B 19/24* (2013.01); *F04F 1/04* (2013.01)

(58) Field of Classification Search
USPC ..... 60/646, 652, 654, 659, 660–663, 665,60/667, 670, 678; 417/207–209, 366–367
See application file for complete search history.

(56) References Cited

U.S. PATENT DOCUMENTS

| | | | | |
|---|---|---|---|---|
| 5,896,746 | A * | 4/1999 | Platell | F01K 23/065 60/618 |
| 6,751,959 | B1 | 6/2004 | McClanahan et al. | |
| 7,971,424 | B2 | 7/2011 | Masada | |
| 8,061,139 | B2 | 11/2011 | Bronicki | |
| 2009/0107144 | A1 | 4/2009 | Moghtaderi et al. | |
| 2011/0113780 | A1 | 5/2011 | Lehar | |
| 2011/0178647 | A1 * | 7/2011 | Mlcak | F01K 13/02 700/288 |
| 2011/0278846 | A1 | 11/2011 | Landi et al. | |
| 2012/0055159 | A1 * | 3/2012 | Hicks | F01K 27/00 60/650 |
| 2012/0085086 | A1 * | 4/2012 | Bollinger | H02J 15/006 60/408 |
| 2012/0125002 | A1 | 5/2012 | Lehar et al. | |

* cited by examiner

SYSTEM AND METHOD FOR GENERATING ELECTRIC POWER

BACKGROUND

The disclosure relates generally to a system and method for generating power and more particularly, to a system and method for generating electric power, using a turboexpander coupled to a thermal pump.

In a typical power generation application, a power plant using a Rankine system utilizes a pump to feed a pressurized liquid from a condenser to a boiler or a heat exchanger. The heat exchanger is used to vaporize the liquid to a gas. Further, a turboexpander is coupled to the heat exchanger to receive the gas and expand the gas for driving a generator to generate electric power. The pump used to feed the pressurized liquid to the heat exchanger, generally consumes a significant portion of the electric power generated from the generator. This significantly reduces the overall efficiency of the power plant.

Thus, there is a need for an improved system and method for increasing the efficiency of the power plant.

BRIEF DESCRIPTION

In accordance with one exemplary embodiment of the present invention, a system for generating electric power is disclosed. The system includes a thermal pump coupled to a buffer chamber and to a fluid source. The thermal pump includes a first channel to receive a first fluid from the fluid source through a first valve. Further, the thermal pump includes a second channel for circulating a second fluid through a second valve. The second fluid is circulated in heat exchange relationship at a constant volume of the first fluid to heat the first fluid for generating a pressurized gas. The thermal pump further includes a third channel for discharging a portion of the pressurized gas to the buffer chamber through a check valve. Further, the thermal pump includes a fourth channel for discharging a further portion of the pressurized gas through a third valve. The system further includes a turboexpander for receiving and expanding the further portion of the pressurized gas from the thermal pump. Further, the system includes a generator coupled to the turboexpander and configured to generate the electric power.

In accordance with another exemplary embodiment of the present invention, a method for generating electric power is disclosed. The method includes receiving a first fluid from a fluid source, through a first valve and first channel, into a thermal pump, until a temperature equilibrium state is established between the thermal pump and the fluid source. Further the method includes circulating a second fluid through a second channel and a second valve of the thermal pump, wherein the second fluid is circulated in heat exchange relationship with the first fluid to heat the first fluid, at a constant volume of the first fluid to generate a pressurized gas. Also, the method includes discharging a portion of the pressurized gas from the thermal pump to a buffer chamber via a third channel and a check valve, until a first pressure equilibrium state is established between the thermal pump and the buffer chamber. Further, the method includes discharging a further portion of the pressurized gas from the thermal pump to a turboexpander via a fourth channel and a third valve, until a second pressure equilibrium state is established between the fluid source and an inlet of the turboexpander. Also, the method includes expanding the further portion of the pressurized gas in the turboexpander for driving a generator to generate electric power.

In accordance with yet another exemplary embodiment of the present invention, a system for generating electric power is disclosed. The system includes a main turboexpander coupled to a condenser for condensing a gas fed from the main turboexpander, to produce a condensed liquid. Further, the system includes a thermal pump coupled to the condenser via a liquid pump, for receiving the liquid into a first channel of the thermal pump. Further, the thermal pump includes a second channel to circulate a portion of the gas from the main turboexpander, in heat exchange relationship with the liquid to vaporize the liquid, at a constant volume of the liquid and generate a pressurized gas. Further, the thermal pump includes a third channel for discharging a portion of the pressurized gas to a buffer chamber through a check valve. Further, the thermal pump includes a fourth channel for discharging a further portion of the pressurized gas through a third valve. The system further includes an auxiliary turboexpander coupled to the thermal pump via a fourth channel for receiving and expanding the further portion of the pressurized gas. Further, the system includes a first generator coupled to the auxiliary turboexpander, for generating electric power.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

While only certain features of the invention have been illustrated and described herein, many modifications and changes will occur to those skilled in the art. It is, therefore, to be understood that the appended claims are intended to cover all such modifications and changes as fall within the true spirit of the invention.

Embodiments herein disclose a system for generating electric power using a turboexpander coupled to a thermal pump. The system includes the thermal pump having a first channel for receiving a first fluid and a second channel for circulating a second fluid in a heat exchange relationship with the first fluid for heating the first fluid to generate a pressurized gas. The system further includes a buffer chamber coupled to the thermal pump, for receiving a portion of the pressurized gas from the thermal pump. The system further includes a turboexpander coupled to the thermal pump, for receiving a further portion of the pressurized gas from the thermal pump and driving a generator for generating electric power.

There are sensors used to sense one or more states in the thermal pump, fluid source, buffer chamber and other elements. As used herein, the sensor used refers to devices, such as pressure transducer, thermocouple and other generic sensors that can sense the intended conditions. These sensors are used to output signal indicative of the sensed conditions. Additionally, there are control devices used to control the flow between the thermal pump, turboexpander, buffer chamber and other elements. As used herein, the control devices refer to devices, such as valves, check valve that control the flow of liquid and gases. In some cases, the control devices can quickly open or close while in other situations the control devices can regulate the flow. In some examples, the control devices are set to operate at predefined values while in other examples, the control devices are dynamically controlled using a control unit. The control unit includes a programmable interface for allowing user to define one or more conditions to dynamically control the control devices. The conditions for operating each control devices are programmed in a non-transitory computer readable medium.

More specifically, certain embodiments of the present system relate to the thermal pump and various configurations of the thermal pump in a typical Rankine system for generating electrical power using the pressurized gas from the thermal pump. The thermal pump configured in the Rankine system is used to heat the condensed liquid to generate the pressurized gas, which can be used for expanding in the turboexpander for driving the generator to generate electrical power.

Figure 1:
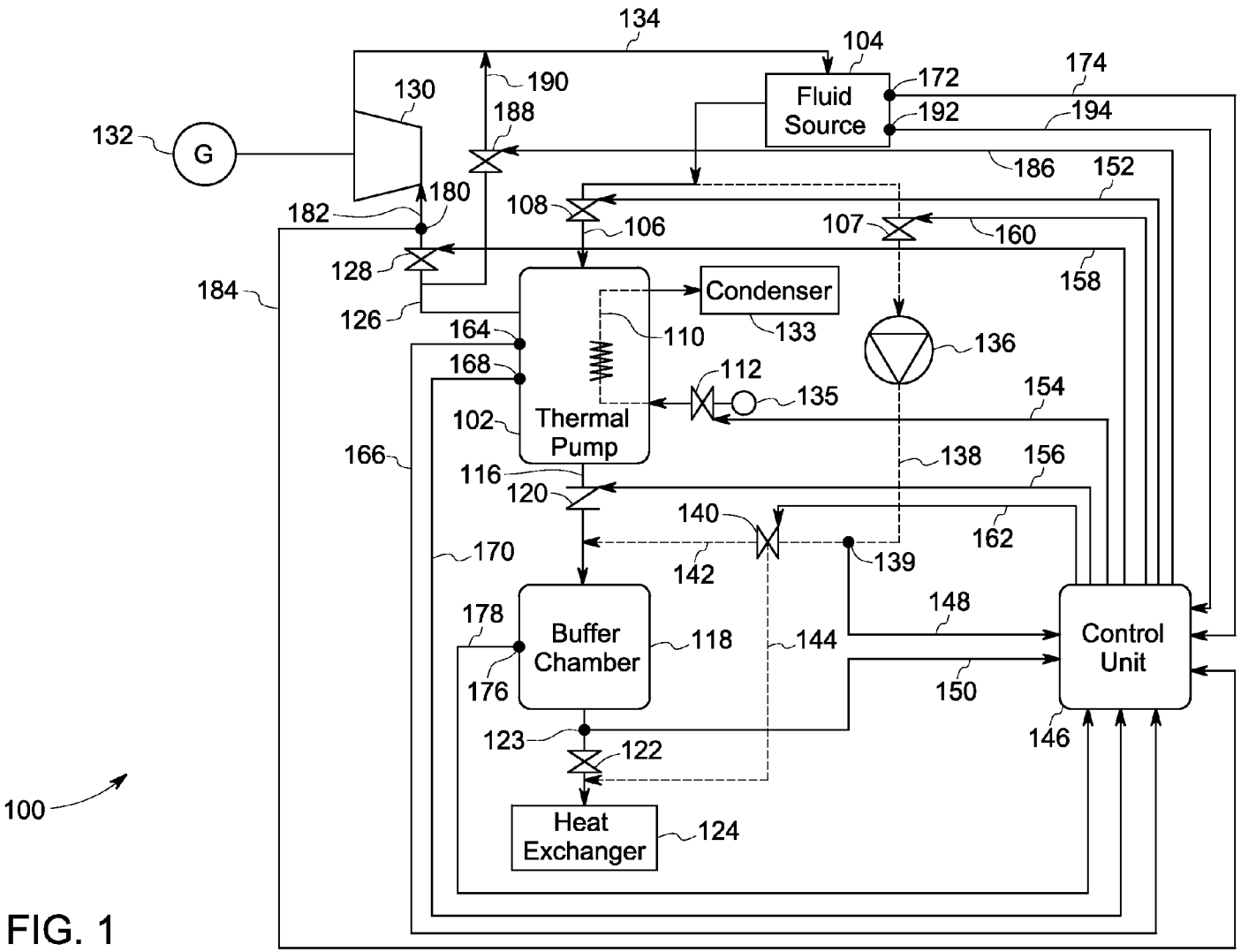
FIG. 1 is a schematic diagram of an exemplary system for generating a pressurized gas, which can be used either for generating electric power or can be stored in a buffer chamber for further utilization in a Rankine cycle system, for example in accordance with one embodiment of the present system.

FIG. 1 is a schematic diagram of an exemplary system 100 for generating a pressurized gas, which can be used either for generating electric power or can be stored in a buffer chamber 118 for further utilization in a Rankine cycle system, for example. In the illustrated embodiment, the system 100 includes a thermal pump 102, a fluid source 104, a first valve 108, a second valve 112, a check valve 120, the buffer chamber 118, a third valve 128, a turboexpander 130, and a generator 132. The system may further include a control unit 146, a pump 136 (herein also referred to generically as a "compression device"), and a heat exchanger 124.

The fluid source 104 (herein also referred as "a first fluid source") is coupled to the thermal pump 102 and optionally to the pump 136. The fluid source 104 is used for feeding a first fluid to the thermal pump 102. In certain embodiments, a portion of the first fluid may also be fed to the pump 136 via a valve 107 depending on certain operating conditions discussed herein. In one embodiment, the first valve 108 and the valve 107 may be coupled to the first fluid source 104 via a fluid pump (not illustrated in FIG. 1). The first fluid from the first fluid source 104 may be a liquid medium or a gaseous medium. In one embodiment, the fluid source 104 is a condenser. The thermal pump 102 includes a first channel 106 for receiving the first fluid from the fluid source 104 through the first valve 108. The fluid pump may be used for feeding the first fluid from the fluid source 104 to the first channel 106 of the thermal pump 102 and the portion of the first fluid to the pump 136. In another embodiment, a gravitational force may be employed for feeding the first fluid from the fluid source 104 to the thermal pump 102 and the portion of the first fluid to the pump 136.

According to one embodiment, the first valve 108 is opened to start the flow of the first fluid through the first channel 106 based on a predefined temperature of the thermal pump 102. The predefined temperature of the thermal pump 102 that triggers opening of the first valve 108 may vary depending on the application and design criteria. In some embodiments, the predefined temperature may be varied dynamically depending on the application. The first valve 108 is opened to provide the flow of the first fluid through the first channel 106 so as to fill the thermal pump 102 with the first fluid. In one embodiment, the first valve 108 remains open and provide the first fluid to the thermal pump 102 until a temperature equilibrium state is established between the thermal pump 102 and the fluid source 104. In one example, the first valve 108 is closed when the temperature equilibrium state is established between the thermal pump 102 and the fluid source 104. In the illustrated embodiment, a temperature sensor 164 is coupled to the thermal pump 102 and used to sense the temperature of the thermal pump 102. Similarly, another temperature sensor 172 is coupled to the first fluid source 104 and used to sense the temperature of the first fluid source 104. The temperature sensor 164 outputs a signal 166 representative of the temperature of the thermal pump 102 to the control unit 146. Similarly, the temperature sensor 172 outputs a signal 174 representative of the temperature of the fluid source 104 to the control unit 146. In such an embodiment, the control unit 146 outputs a control signal 152 to control the opening and closing of the first valve 108 based on the signals 166, 174 for allowing the flow of the first fluid through the first channel 106 of the thermal pump 102. It should be noted herein that the temperature equilibrium state refers to a state in which the temperature of the thermal pump 102 and the fluid source 104 are approximately the same. In a specific example, the temperature equilibrium state of the first fluid is about 300 degrees Fahrenheit and the predefined temperature of the thermal pump 102 at which the first valve 108 allows flow of the first fluid to the thermal pump 102 is about 600 degrees Fahrenheit.

The thermal pump 102 further includes a second channel 110 for circulating a second fluid in heat exchange relationship with the first fluid in the thermal pump 102 through the second valve 112. In the illustrated embodiment, the second fluid is received from a second fluid source 135. In another embodiment, the second fluid may be received from a channel 134 coupled to the turboexpander 130. The second fluid may be a liquid medium or a gaseous medium. In one embodiment, the second valve 112 controls the flow of the second fluid from the second fluid source 135 before discharging the second fluid to a condenser 133 via the second channel 110. In another embodiment, the second valve 112 controls the flow of the second fluid from the second fluid source 135 before discharging the second fluid to the first fluid source 104 via the second channel 110 (not represented in FIG. 1).

In one example, the second valve 112 is opened to start flow of the second fluid through the second channel 110, based on the closure of the first valve 108 or based on attaining the temperature equilibrium state between the thermal pump 102 and the first source 104. The second fluid from the second fluid source 135 is circulated in heat exchange relationship with the first fluid from the first fluid source 104, so as to heat the first fluid in the thermal pump 102. In one example, the first fluid is heated, at a constant volume of the first fluid, to generate a pressurized gas that attains a predefined pressure. The predefined pressure in the thermal pump 102 should be greater than the pressure in the buffer chamber 118.

In the illustrated embodiment, the control unit 146 starts circulation of the second fluid through the second channel 110 based on the signals 166, 174. The control unit 146 determines the temperature equilibrium state between the first fluid source 104 and thermal pump 102 based on the signals 166, 174. For example, in the illustrated embodiment, a pressure sensor 168 is coupled to the thermal pump 102 and used to sense the pressure in the thermal pump 102. The pressure sensor 168 outputs a signal 170 representative of the pressure in the thermal pump 102, to the control unit 146. In such an embodiment, the control unit 146 outputs a control signal 154 to control the closing of the second valve 112 based on the signal 170, so as to stop the circulation of the second fluid through the second channel 110 of the thermal pump 102, as the pressurized gas in the thermal pump 102 attains the predefined pressure. The predefined pressure that triggers closing of the second valve 112 may vary depending on the application and design criteria. The predefined pressure may be varied dynamically depending on the application. In a specific embodiment, the predefined pressure in the buffer chamber 118 is about 20 bars.

Further, the thermal pump 102 is coupled to the buffer chamber 118 via the check valve 120. The check valve 120 is used for controlling discharge of a portion of the pressurized gas from the thermal pump 102 to the buffer chamber 118. In this example, the check valve 120 is opened to start discharge of the portion of pressurized gas through a third channel 116 of the thermal pump 102, into the buffer chamber 118. In one embodiment, the check valve 120 is opened for discharging the portion of the pressurized gas to the buffer chamber 118 based on the pressurized gas attaining the predefined pressure in the thermal pump 102. In this example, the discharge of the pressurized gas through the third channel 116 is maintained until a first pressure equilibrium state is established between the thermal pump 102 and the buffer chamber 118. In this example, the check valve 120 is closed when the first pressure equilibrium state is established between thermal pump 102 and the buffer chamber 118. In the illustrated embodiment, a pressure sensor 176 is coupled to the buffer chamber 118 and used to sense the pressure in the buffer chamber 118. The pressure sensor 176 outputs a signal 178 representative of the pressure in the buffer chamber 118, to the control unit 146. In such an embodiment, the control unit 146 outputs a control signal 156 to control the closing of the check valve 120 based on the signals 170, 178, so as to stop the discharge of the portion of the pressurized gas to the buffer chamber 118, when the first pressure equilibrium state is established between the thermal pump 102 and the buffer chamber 118. The control unit 146 determines the first pressure equilibrium state between the thermal pump 102 and the buffer chamber 118 based on the signals 170, 178. It should be noted herein that first pressure equilibrium state refers to a state in which the pressure in the thermal pump 102 and the buffer chamber 118 are same. In a specific embodiment, the first pressure equilibrium state may be equal to about 10 bars. In another specific embodiment, the first pressure equilibrium state may be in the range of about 10-20 bars. The check valve 120 in this example is a uni-directional valve and does not permit reverse flow of the pressurized gas from the buffer chamber 118 to the thermal pump 102.

The thermal pump 102 is further coupled to the turboexpander 130 via the third valve 128. The third valve 120 is used for controlling discharge of a further portion of the pressurized gas from the thermal pump 102 to the turboexpander 130. In this example, the third valve 128 is opened for discharging the further portion of the gas, on establishment of the first pressure equilibrium state between the thermal pump 102 and the buffer chamber 118. In this example, the third valve 128 is opened for discharging the further portion of the pressurized gas through a fourth channel 126 of the thermal pump 102 to the turboexpander 130, via an inlet 182 of the turboexpander 130. The third valve 128 is opened to maintain flow of the further portion of the gas, until a second pressure equilibrium state is established between the fluid source 104 and the inlet 182 of the turboexpander 130. In this example, the third valve 128 is closed when the second pressure equilibrium state is established between fluid source 104 and the inlet 182 of the turboexpander 130. In this example, a by-pass channel 190 extends from the fourth channel 126 to the channel 134, bypassing the turboexpander 130. The by-pass channel 190 is provided with a fourth valve 188. The fourth valve 188 is used to control discharge of at least some of the further portion of the pressurized gas from the thermal pump 102 to the fluid source 104, via the by-pass channel 190. The fourth valve 188 is opened based on the second pressure equilibrium state and closure of the third valve 128. The fourth valve 188 is closed, based on an empty state of the thermal pump 102. In another embodiment, the fourth valve 188 is closed, when the temperature of the thermal pump 102 attains the predefined temperature. Further, the first valve 108 is opened to allow the flow of the first fluid through from the fluid source 104 to the thermal pump 102. The sequence is repeated as required. In the illustrated embodiment, a pressure sensor 180 is coupled to the inlet 182 of the turboexpander 130, to sense the pressure of the gas fed from the thermal pump 102 to the turboexpander 130. Similarly, a pressure sensor 192 is coupled to the fluid source 104, to sense the pressure of the first fluid in the fluid source 104. The pressure sensor 180 outputs a signal 184 representative of the pressure of the gas fed to the turboexpander 130. Similarly, the pressure sensor 192 outputs a signal 194 representative of the pressure of the first fluid in the fluid source 104. In such an embodiment, the control unit 146 outputs a control signal 158 to control the closing of the third valve 128 based on the signal 184, 194, so as to stop the discharge of the further portion of the pressurized gas to the turboexpander 130, when the second pressure equilibrium state is established between the fluid source 104 and the inlet 182 of the turboexpander 130. The control unit 146 determines the second pressure equilibrium state between the fluid source 104 and the inlet 182 of the turboexpander 130 based on the signals 184, 194. Further, the control unit 146 outputs a control signal 186 to control the opening of the fourth valve 188 based on the signals 184, 194. The control unit 147 outputs the control signal 186 to control the closing of the fourth valve 188 based on empty state of the thermal pump. In another embodiment, the control unit 147 outputs the control signal 186 to control the closing of the fourth valve 188 based on the signal 174, which is representative of the temperature of the thermal pump 102.

In the illustrated embodiment, the turboexpander 130 is operably coupled to the thermal pump 102, the generator 132, and the fluid source 104. The turboexpander 130 receives the further portion of the pressurized gas from the fourth channel 126 of the thermal pump 102, expands the received further portion of the pressurized gas, and in-turn drives the generator 132 for generating electric power. In the illustrated embodiment, the expanded gas is discharged from the turboexpander 130 to the fluid source 104 via the channel 134.

In the illustrated embodiment, the buffer chamber 118 is used to store the portion of the pressurized gas and feed the portion of the pressurized gas to the heat exchanger 124 (for e.g. boiler), which in one example is at a constant flow rate via a valve 122. In such an example, the constant flow rate of the pressurized gas may be maintained by using a mass flow meter (not illustrated in FIG. 1.). The valve 122 controls the flow of the portion of the pressurized gas from the buffer chamber to the heat exchanger 124. In the illustrated embodiment, the pump 136 is operably coupled to the fluid source 104 and the buffer chamber 118. The pump 136 may receive the portion of the first fluid from the fluid source 104 through the valve 107, and pressurize the portion of the first fluid. In the illustrated embodiment, a sensor 139 is used to sense a medium of a pressurized portion of the first fluid, and outputs a signal 148 representative of the medium of the pressurized portion of the first fluid. In one embodiment, the control unit 146 outputs a control signal 162 to control a valve 140 for discharging a pressurized portion of the first fluid from the compression device 136 to the buffer chamber 118 via a channel 142. In such an embodiment, the pressurized portion of the first fluid is a gaseous medium. In a specific embodiment, the pressure of the pressurized portion of the first fluid may be in the range of 10-20 bars. In another embodiment, the control unit 146 outputs a control signal 162 to control the valve 140 for discharging a pressurized portion of the first fluid from the pump 136 to the heat exchanger 124 via a channel 144. In such an embodiment, the pressurized portion of the first fluid is a liquid medium. The pump 136 may be operated during certain operating conditions such as during start-ups, shutdowns and transient conditions of the system 100. In the illustrated embodiment, a sensor 123 is used to sense the operating conditions of the system 100 and outputs a signal 150 representative of the operating condition of the system 100 to the control unit 146. In such an embodiment, the control unit 146 outputs a control signal 160 to control the opening and closing of the valve 107, for allowing the flow of the portion of the first fluid from the fluid source 104 to the pump 136 based on the signal 150.

In one embodiment, the control unit 146 may be a general purpose processor or an embedded system. The control unit 146 may be configured using inputs from a user through an input device or a programmable interface such as a keyboard or a control panel. A memory module of the control unit 146 may be random access memory (RAM), read only memory (ROM), flash memory, or other type of computer readable memory accessible by the control unit 146. The memory module of the control unit 146 may be encoded with a program for controlling the valves or check valves based on various conditions at which the valves or check valves are defined to be operable.

Figure 2:
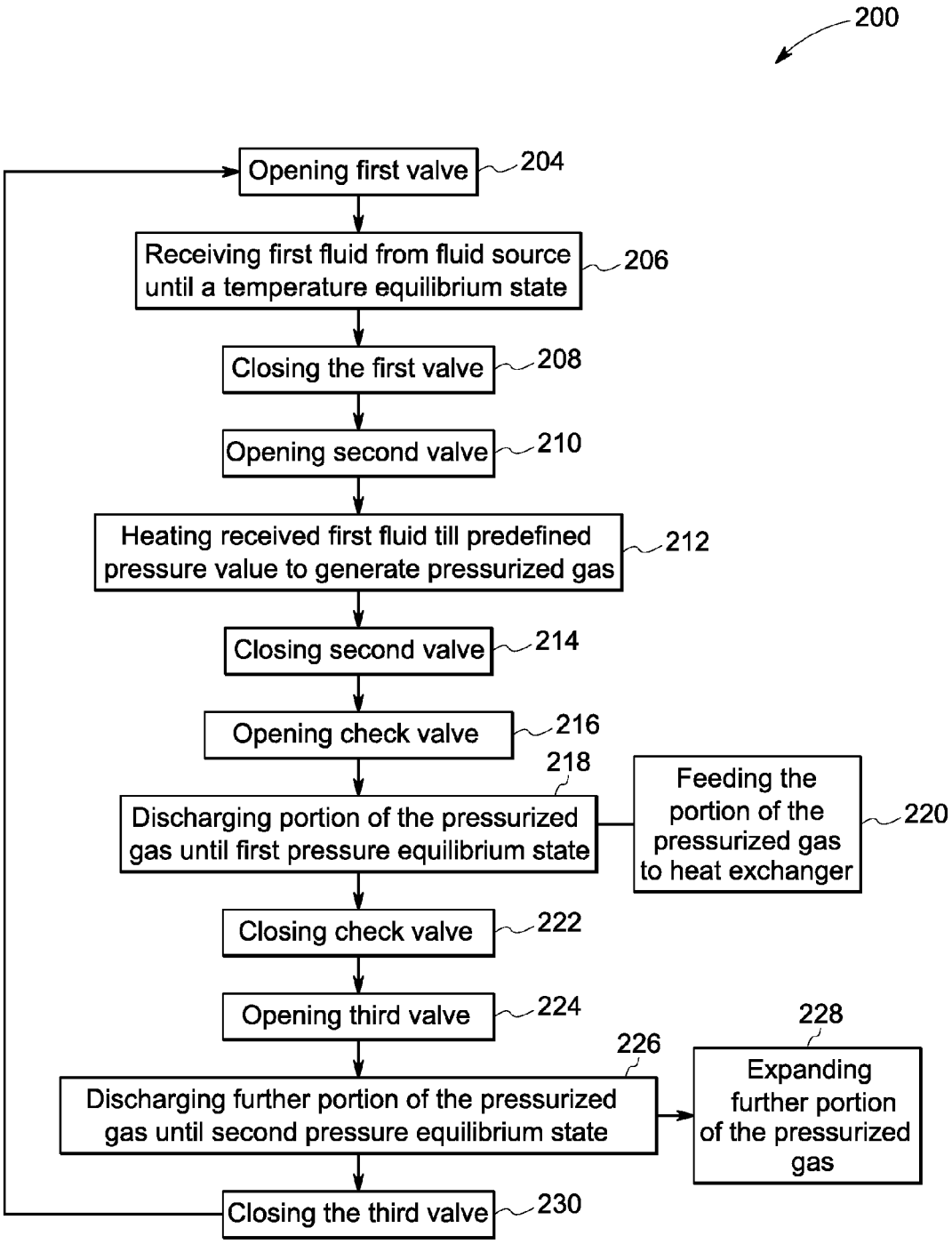
FIG. 2 is a flow diagram illustrating an exemplary method for generating electric power using a generator coupled to a thermal pump and a turboexpander in accordance with one embodiment of the present technique.

FIG. 2 is a flow diagram illustrating an exemplary method 200 for generating electric power using a generator coupled to a thermal pump and a turboexpander. The method 200 is explained in conjunction with the system 100 of FIG. 1.

The first valve 108 is opened 204 and the first fluid flows from the fluid source 104 to the thermal pump 102 as represented by 206. The first valve 108 is maintained in an "opened state" until a temperature equilibrium state is established between the thermal pump 102 and the fluid source 104. In a specific embodiment, the first valve 108 is opened to start flow of the first fluid into the first channel 106 of the thermal pump 102 based on a predefined temperature of the thermal pump 102. The first valve 108 is closed, when the temperature equilibrium state is established between the thermal pump 102 and the fluid source 102 as represented by 208. In such an embodiment, a control unit 146 is used to control opening and closing of the first valve 108 for allowing the first fluid to flow through the first channel 106 of the thermal pump 102.

Upon closure of the first valve 108, the second valve 112 is opened, for circulating the second fluid through the second channel 110 of the thermal pump 102 as represented by 210. In another embodiment, the second valve 112 is opened, for circulating the second fluid through the second channel 110 of the thermal pump 102 on establishment of the temperature equilibrium state and on closure of first valve 108. The circulation of the second fluid induces heat exchange between the lower temperature first fluid and the higher temperature second fluid causing the heating of the first fluid to generate a pressurized gas 212. In one embodiment, the second fluid is received from the second fluid source 135. In another embodiment, the second fluid may be received from the channel 134 coupled to the turboexpander 130. In one embodiment, the second fluid circulated in the second channel 110 may be discharged to the condenser 133 via the second channel 110. In another embodiment, the second fluid circulated in the second channel 110 may be discharged to the first fluid source 104. The heat exchange between the first fluid and the second fluid is continued till the pressure of the generated gas attains a predefined pressure. The second valve 112 is closed, to stop the circulation of the second fluid through the second channel 110 when the pressurized gas attains the predefined pressure 214. In such an embodiment, the control unit 146 may control the opening and closing of the second valve 108 for allowing the circulation of the second fluid through the second channel 110 of the thermal pump 102.

The check valve 120 is opened, after the pressurized gas within the thermal pump 102 has attained the predefined pressure, and the second valve 112 is closed 216. The check valve 120 controls the discharge of the pressurized gas from the third channel 116 of the thermal pump 102 to the buffer chamber 118, as represented by 218. The check valve 120 is maintained in the opened state for discharging a portion of the pressurized gas until a first pressure equilibrium state is established between the thermal pump 102 and the buffer chamber 118. When the first pressure equilibrium state is established, the check valve 120 is closed 222. In such an embodiment, the control unit 146 may control the opening and closing of the check valve 120 for allowing discharge of the portion of the pressurized gas to the buffer chamber 118. The third valve 128 is opened, after the first pressure equilibrium state is attained between the thermal pump 102 and the buffer chamber 118, and the check valve 120 is closed. The third valve 128 is opened for discharging a further portion of the pressurized gas from the fourth channel 126 of the thermal pump 102 to the turboexpander 130 as represented by 224. The third valve 128 is opened for discharging the further portion of the pressurized gas until a second pressure equilibrium state is established between the fluid source 104 and the inlet 182 of the turboexpander 130 as represented by 226. When the second pressure equilibrium state is established, the third valve 128 is closed 230. In such an embodiment, the control unit 146 is used to control the opening and closing of the third valve 128 for discharging the further portion of the pressurized gas from the thermal pump 102 to the turboexpander 130.

In some embodiments, the portion of the pressurized gas stored in the buffer chamber 118 may be fed to the heat exchanger 124 as represented by 220. The buffer chamber 118 in this example is configured to maintain constant flow rate of the pressurized gas to the heat exchanger 124. In such an embodiment, the constant flow rate of the pressurized gas is maintained by using a mass flow meter (not illustrated in FIG. 1.). The further portion of the pressurized gas is expanded via the turboexpander 130 for driving the generator 132 for generating electric power, as represented by 228. The sequence is repeated as required.

Figure 3:
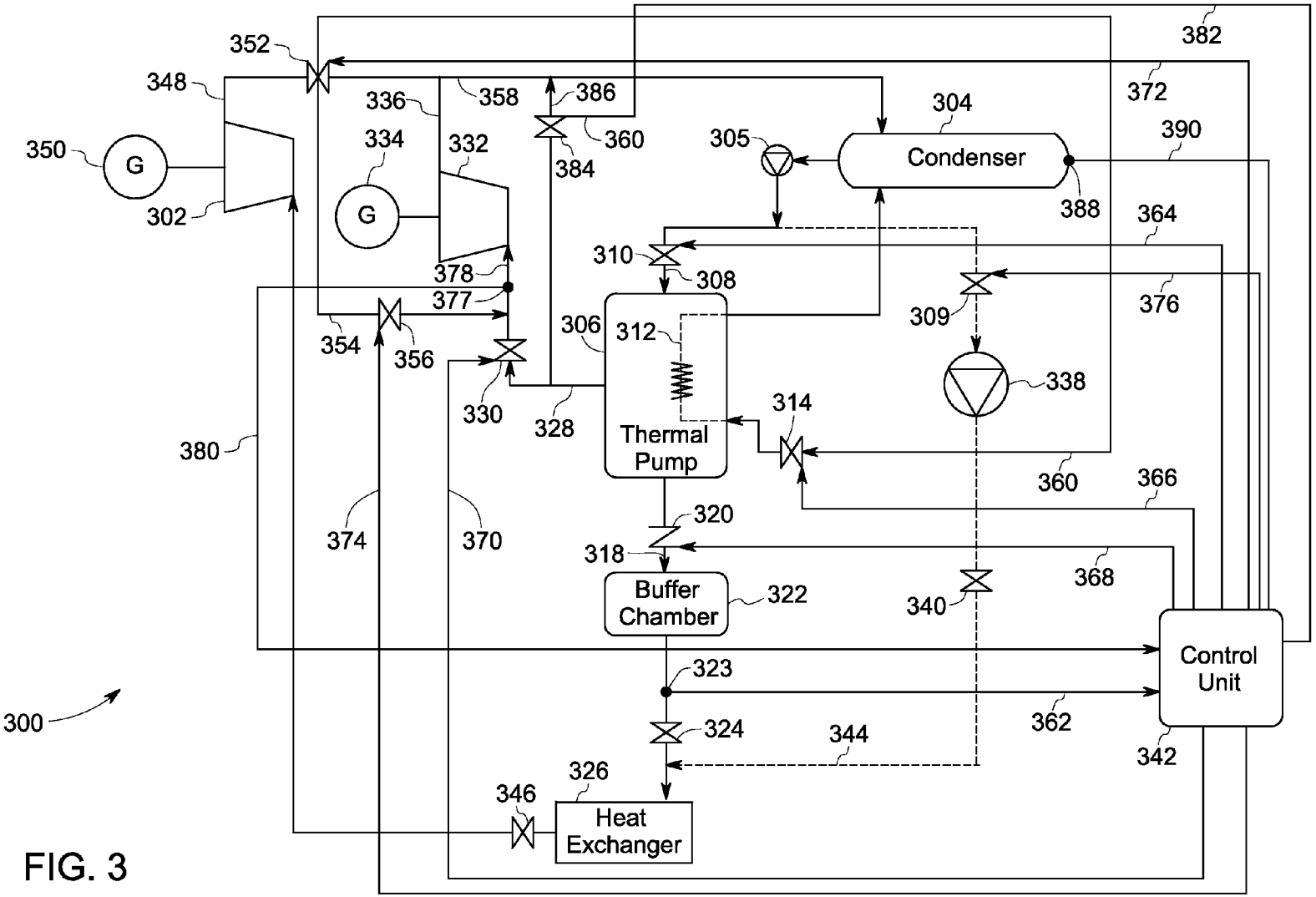
FIG. 3 is a block diagram of an exemplary Rankine system having a thermal pump coupled with a turboexpander in accordance with an exemplary embodiment of the present system.

FIG. 3 is a block diagram illustrating an exemplary Rankine system 300 for generating electric power. The system 300 includes a condenser 304, a thermal pump 306, a buffer chamber 322, a heat exchanger 326, an auxiliary turboexpander 332, a main turboexpander 302, a first generator 334 and a second generator 350. The system 300 may additionally include a pump 338, and a control unit 342.

Similar to the previous embodiments, the exemplary system 300 may include a temperature sensor and a pressure sensor (not shown in FIG. 3) in the thermal pump 306. Further, the system 300 may include a temperature sensor in the condenser 304 and a pressure sensor in the buffer chamber 322. The control unit 342 may receive the signals from the temperature sensors and the pressure sensors for controlling the respective valves, and check valve for allowing the flow of gases or liquid, based on the corresponding conditions. The above mentioned temperature sensors and the pressure sensors are not illustrated in FIG. 3, to keep the description of the Rankine system 300 simple, and should not be considered as a limitation of the system 300.

The condenser 304 is coupled to the main turboexpander 302, for receiving an expanded gas from the main turboexpander 302. The condenser 304 is further coupled to the thermal pump 306 and optionally to the pump 338 via a pump 305. In certain embodiments, the pump 338 may receive a portion of the condensed liquid from the condenser 304 via the pump 305 and controlled by a valve 309, depending on certain operating conditions discussed herein. In another embodiment, a gravitational force may be employed for feeding the condensed liquid from the condenser 304 to the thermal pump 306, and the pump 338. In such an embodiment, the condenser 304 is placed upstream of the thermal pump 304 and the pump 338 for feeding the condensed liquid by gravity. It should be noted herein that the terms "first fluid" and the "liquid" are used interchangeably. Also, the terms the "second fluid" and "gas" are also used interchangeably.

In the illustrated embodiment, the thermal pump 306 includes a first channel 308 which receives the condensed liquid from a liquid pump 305 through a first valve 310. In one embodiment, the first valve 310 is opened based on a predefined temperature of the thermal pump 306. The first valve 310 controls flow of the liquid from the pump 305 to the thermal pump 306 until a temperature equilibrium state is established between the thermal pump 306 and the condenser 304. In an exemplary embodiment, the temperature equilibrium state is about 300 degrees Fahrenheit and the predefined temperature at which the first valve is configured to open is about 600 degrees Fahrenheit. The first valve 310 in this example is closed when the temperature equilibrium state is established between the thermal pump 306 and the condenser 304. It should be noted herein that the temperature equilibrium state refers to a state in which the temperature of the thermal pump 306 and the condenser 304 are the same. In the illustrated embodiment, the control unit 342 outputs a control signal 364 to control the opening and closing of the first valve 310 for allowing the flow of the liquid in the thermal pump 306.

The thermal pump 306 includes a second channel 312 for circulating a portion of the gas from the main turboexpander 302 through the second valve 314. The portion of the gas is circulated through the second channel 312 in a heat exchange relationship with the liquid for heating and vaporizing the liquid at a constant volume of the liquid, to generate a pressurized gas. The second valve 314 is opened to start circulation of the portion of the gas through the second channel 312 based on the temperature equilibrium state established between the thermal pump 306 and the condenser 304. In another embodiment, the circulation of the portion of the gas through the second channel is based on closure of the first valve 310. The second channel 312 allows circulation of the portion of the gas in heat exchange relationship with the liquid, to generate the pressurized gas, until the generated pressurized gas attains a predefined pressure within the thermal pump 306. The second valve 314 is closed to stop circulation of the portion of the gas through the second channel 312 based on the attained predefined pressure of the pressurized gas within the thermal pump 306. In one embodiment, the portion of the gas circulated in the second channel 312 may be discharged to the condenser 304. In another embodiment, the portion of the gas circulated in the second channel 312 may be discharged to a different condenser (not shown). In the illustrated embodiment, the control unit 342 outputs a control signal 366 to control the opening and closing of the second valve 314 for allowing circulation of the portion of the gas into the second channel 312 of the thermal pump 306. In an exemplary embodiment, the predefined pressure may be about 20 bars.

The thermal pump 306 is further coupled to the buffer chamber 322 via a check valve 320. The check valve 320 controls discharge of a portion of the pressurized gas from the third channel 318 of the thermal pump 306 to the buffer chamber 322. The check valve 320 is opened after second valve 314 is closed and the pressurized gas attains the predefined pressure within the thermal pump 306. The check valve 320 in this example is a uni-directional valve and does not permit reverse flow of the pressurized gas from the buffer chamber 322 to the thermal pump 306. The check valve 320 permits discharge of the portion of the pressurized gas to the buffer chamber 322, until a first pressure equilibrium state is been established between the buffer chamber 322 and the thermal pump 306. It should be noted herein that the first pressure equilibrium state refers to a state in which the pressure in the thermal pump 306 and the buffer chamber 322 are same. The check valve 320 is closed to stop discharge of the portion of the pressurized gas when the first pressure equilibrium state is established between the buffer chamber 322 and the thermal pump 306. In the illustrated embodiment, the control unit 342 outputs a control signal 368 to control the opening and closing of the check valve 320 for discharging the portion of the pressurized gas into the buffer chamber 322 through a third channel 318. In an exemplary embodiment, the first pressure equilibrium state may be equal to about 10 bars.

The buffer chamber 322 is coupled to the heat exchanger 326 via a valve 324. The buffer chamber 322 is configured to store the portion of the pressurized gas and feed the portion of the pressurized gas to the heat exchanger 326 at a constant flow rate. In such an embodiment, to maintain the constant flow rate of the portion of the pressurized gas to the heat exchanger 326 a mass flow meter is used (not illustrated in FIG. 3.). The heat exchanger 326 is further coupled to the main turboexpander 302. The heat exchanger 326 in one example heats the pressurized gas before feeding a heated portion of the pressurized gas to the main turboexpander 302 via a valve 346.

The thermal pump 306 is further coupled to the auxiliary turboexpander 332 via a third valve 330. In the illustrated embodiment, a by-pass channel 386 extends from a fourth channel 328 to a channel 358, bypassing the auxiliary turboexpander 332. The by-pass channel 386 is provided with a fourth valve 384. The thermal pump 306 is configured to discharge a further portion of the pressurized gas through the fourth channel 328 of the thermal pump 306 to an inlet 378 of the auxiliary turboexpander 332. The opening of the third valve 330 is dependent on closure of the check valve 320. In another embodiment, the opening of the third valve may be dependent on attaining the first pressure equilibrium state between the thermal pump 306 and the buffer chamber 322. The third valve 330 controls discharge of the further portion of the pressurized gas to the auxiliary turboexpander 332 until a second pressure equilibrium state is established between the condenser 304 and the inlet 378 of the auxiliary turboexpander 332. The third valve 330 is closed to stop discharge of the further portion of the pressurized gas when the second pressure equilibrium state is attained. The fourth valve 384 is opened to discharge at least some of the further portion of the pressurized gas from the thermal pump 306 to the fluid source 304 via the by-pass channel 386 and the channel 358 based on closure of the third valve 330 and the second pressure equilibrium state. In the illustrated embodiment, a pressure sensor 377 is coupled to the inlet 378 of the auxiliary turboexpander 332 to sense the pressure of the gas fed from the main expander 302 and the thermal pump 306. Similarly, a pressure sensor 388 is coupled to the condenser 304 to sense the pressure of the liquid in the condenser 304. The sensor 377 outputs a signal 380 representative of the pressure of the gas fed to the auxiliary turboexpander 332, to the control unit 342. The sensor 388 outputs a signal 390, representative of the pressure of the liquid in the condenser 304, to the control unit 342. In such an embodiment, the control unit 342 outputs a control signal 370 to control the opening and closing of the third valve 330 for allowing discharge of the further portion of the pressurized gas from the thermal pump 306 into the turboexpander 332, based on the signals 380, 390. Further, the control unit 342 outputs a control signal 382 to control the opening and closing of the fourth valve 384 for allowing discharge at least some of the further portion of the pressurized gas from the thermal pump 306 into the condenser 304, via the by-pass channel 386 and the channel 358. In this example, the by-pass channel 386 is configured to feed some of the further portion of the pressurized gas, bypassing the auxiliary turboexpander 332 upon establishment of the second pressure equilibrium state.

The auxiliary turboexpander 332 is coupled to the first generator 334 and the thermal pump 306. The auxiliary turboexpander 332 expands the further portion of the pressurized gas received from the fourth channel 328 of the thermal pump 306 and drives the first generator 334 for generating electric power. The expanded gas is discharged to the condenser 304 via channels 336, 358. A portion of the expanded gas from the main turboexpander 302 may be fed to the auxiliary turboexpander 332 via channels 348, 354. In such an embodiment, the control unit 342 outputs control signals 372, 374 to control valves 352, 356 for allowing the flow of the portion of the expanded gas through the corresponding channels 348, 354 based on the operation of the third valve 330. In one embodiment, when the third valve 330 is opened for discharging the further portion of the pressurized gas from the thermal pump 306 to the auxiliary turboexpander 332, the valve 356 is closed. When the third valve 330 is closed, the valve 356 is opened for discharging the portion of the expanded gas from the main expander 302 to the auxiliary turboexpander 332. The main turboexpander 302 is disposed upstream of the auxiliary turboexpander 332.

The main turboexpander 302 is coupled to the heat exchanger 326 through the valve 346. The main turboexpander 302 receives the heated portion of the pressurized gas from the heat exchanger 326 and expands the heated portion of the pressurized gas for driving the second generator 350 to generate electric power.

The main turboexpander 302 is further coupled to the condenser 304 via the channels 348, 358. The valve 352 is a three-directional valve and is configured to discharge the expanded gas to the condenser 304 via the channels 348, 358, to the second channel 312 of the thermal pump 306 via channels 348, 360, and to the auxiliary turboexpander 332 via the channels 348, 354. In one embodiment, the flow of the expanded gas is continuous to the condenser 304 through the channels 348, 358. In another embodiment, the flow of the expanded gas via the channel 348, from the main turboexpander 302 to either the second channel 312 of the thermal pump via the channel 360 or to the auxiliary turboexpander 332 via the channel 354 is periodic. The periodic flow of the expanded gas is controlled using the control unit 342. In one embodiment, the control unit 342 outputs the control signals 372, 366 to control the periodic flow of the expanded gas, to the second channel 312 of the thermal pump 306, via the channel 360, and the flow occurs when the second valve 314 is opened for feeding the portion of the expanded gas (herein also referred as the "second fluid") from the main turboexpander 302. Similarly, the control unit 342 outputs the control signals 372, 374 to control the periodic flow of the expanded gas to the auxiliary turboexpander 332 via the channels 348, 354, and the flow occurs when the valve 356 is opened for feeding the portion of the expanded gas to the auxiliary turboexpander 332.

The pump 338 is coupled to the condenser 304 via the liquid pump 305. The pump 338 is configured to receive the portion of the condensed liquid from the condenser 304 via a valve 309, during certain operating conditions such as during start-ups, shut-downs and transients condition of the system 300. In the illustrated embodiment, the sensor 323 is used to sense the operating conditions of the system 300 and outputs a signal 362 representative of the operating condition of the system 300 to the control unit 342. In such an embodiment, the control unit 342 outputs a control signal 376 to control the opening and closing of the valve 309, for allowing the flow of the portion of the first fluid from the condenser 304 to the pump 338 based on the signal 362. The pump 338 is used to pressurize the portion of the condensed liquid. A valve 340 is used to control discharge of a pressurized portion of the liquid received from the pump 338, to the heat exchanger 326 via a channel 344.

The heat exchanger 326 is coupled to the buffer chamber 322, pump 338 and the main turboexpander 302. In one embodiment, the heat exchanger 326 receives the pressurized gas from the buffer chamber 322 for further heating the pressurized gas before feeding a heated portion of the pressurized gas to the main turboexpander 302. In another embodiment, the heat exchanger 326 may receive the pressurized portion of the liquid from the pump 338 via the channel 344 for further heating the pressurized portion of the liquid to generate a vapor before feeding the vapor to the main expander 302.

In the illustrated embodiment, the main turboexpander 302 coupled to the heat exchanger 326 via the valve 346 is configured to receive the heated portion of the pressurized gas. In such embodiment, the main turboexpander 302 expands the pressurized gas to drive the second generator for generating electric power. In another embodiment, the main turboexpander 302 coupled to the heat exchanger 326 via the valve 346 is configured to receive the vapor. In such embodiment, the main turboexpander 302 expands the vapor to drive the second generator for generating electric power.

Figure 4:
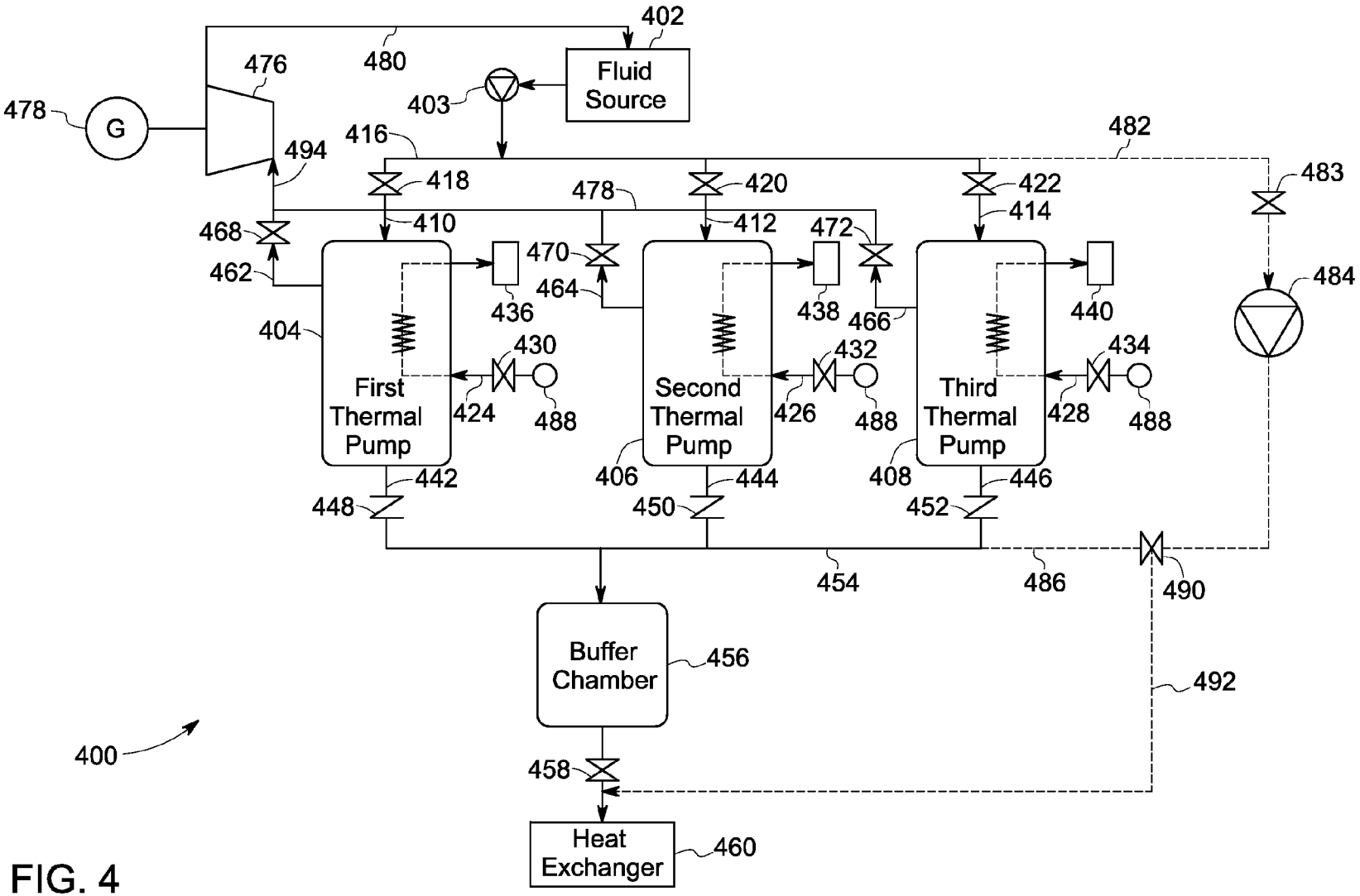
FIG. 4 is a schematic diagram of a system having a plurality of thermal pumps disposed in a parallel arrangement in accordance with an exemplary embodiment of the system.

FIG. 4 is a schematic diagram of one embodiment of a system 400 having a plurality of thermal pumps 404, 406 and 408 disposed in a parallel arrangement for generating a pressurized gas used for generating electric power via a turboexpander 476. In one embodiment, the system 400 includes a fluid source 402, the plurality of thermal pumps 404, 406, 408, a buffer chamber 456, the turboexpander 476, and a generator 478. Additionally, the system 400 includes a pump 484 (herein also referred to generically as a "compression device"), and a heat exchanger 460. The number of the thermal pumps may vary depending on the application.

Similar to the previous embodiments, the system 400 may include a temperature sensor and a pressure sensor in each of the thermal pumps 404, 406, 408 and the fluid source 402 for sensing the temperature and pressure of each of the thermal pumps 404, 406, 408 and the fluid source 402. The system may further include a pressure sensor in the buffer chamber 456 for sensing the pressure in the buffer chamber 456. Further, the system 400 may include one or more sensors for sensing a medium of the pressurized portion of the first fluid fed from the pump/compression device 484. Also, there may be one or more sensors to determine the operating conditions of the system 400 for determining the need for initiating the pump/compression device 484. In such an embodiment, the system 400 may further include a control unit for controlling the respective valves and check valves based on the various conditions appropriate for the valves and check valves. The control unit may receive the signals from the temperature sensor, the pressure sensor, and the one or more sensors for controlling the respective valves, and check valves of the thermal pumps 404, 406, 408 for allowing the flow of gases or liquid or first fluid or second fluid, based on the corresponding conditions. Further, a by-pass channel arrangement discussed with reference to the previous embodiment is also equally applicable to the illustrated embodiment. The sensor arrangements and the control unit are not illustrated in FIG. 4, to keep the description of the system 400 simple, and should not be considered as a limitation of the system 400.

The fluid source 402 (herein also referred as a "first fluid source") is coupled to the plurality of thermal pumps 404, 406, 408 and to a turboexpander 476. The fluid source 402 feeds a first fluid to the plurality of thermal pumps 404, 406, 408 via a fluid manifold 416. The first fluid may be a gaseous medium or a liquid medium. In one embodiment, the fluid source 402 may be a condenser. A fluid pump 403 is used to feed the first fluid from the fluid source 402 to the plurality of thermal pumps 404, 406, 408 via the fluid manifold 416.

In the illustrated embodiment, the plurality of thermal pumps 404, 406 and 408 are further coupled to the buffer chamber 456 via a gas manifold 454. The plurality of thermal pumps 404, 406 and 408 in this example are operated in a predefined sequence. In the illustrated embodiment, the predefined sequence starts with the thermal pump 404 followed by the thermal pumps 406, 408. In other embodiments, the sequence of operation of the thermal pumps may vary based on the application. In the illustrated embodiment, initially, a first valve 418 is opened to allow flow of the first fluid to the first channel 410 of the first thermal pump 404. During the flow of the first fluid to the first channel 410, the other first valves 420, 422 are closed.

When a temperature equilibrium state is established between the first thermal pump 404 and the fluid source 402, the second thermal pump 406 is activated for receiving the first fluid through the corresponding first valve 420, whereas the other first valves 418 and 422 are closed. While the second thermal pump 406 is receiving the first fluid, the second valve 430 corresponding to the first thermal pump 404 is opened to allow circulation of a second fluid through a second channel 424. The second fluid may be fed from a second fluid source 488. In another embodiment, the second fluid source may be fed from a channel 480 of the main turboexpander 476. The second fluid flowing through the second channel 424 is in a heat exchange relationship with the first fluid to heat the first fluid at constant volume of the first fluid, and generate a pressurized gas. The second valve 430 is opened till the pressurized gas attains a predefine pressure in the first thermal pump 404, and thereafter the second valve 430 is closed. The second fluid is discharged to a condenser 436 via the second channel 424. In another embodiment, the second fluid may be discharged to the fluid source 402. Similarly, the second fluid circulated in the second channels 426, 428 of the thermal pumps 406, 408 are discharged to respective condensers 438, 440. When the temperature equilibrium state is established between the second pump 406 and the fluid source 402, the first valve 420 corresponding to the second thermal pump 406 is closed, and the first valve 422 corresponding to the third thermal pump 408 is opened for feeding the first fluid into the first channel 414 of the third thermal pump 408. The first valves 418 and 420 corresponding to the other thermal pumps 404 and 406 are closed. While the third thermal pump 408 is receiving the first fluid, the second valve 432 corresponding to the second thermal pump 406 is opened to allow circulation of the second fluid through a second channel 426 in heat exchange relationship with the first fluid. A pressurized gas is generated in the second thermal pump 406. In the meanwhile, the check valve 448 corresponding to the first thermal pump 404 is opened for discharging a portion of the pressurized gas from the thermal pump 404 to the buffer chamber 456 via the pressurized gas manifold 454, until a first pressure equilibrium state is established between the first thermal pump 404 and the buffer chamber 456. The third valve 468 corresponding to the first thermal pump 404 is opened for discharging a further portion of the pressurized gas to an inlet 494 of the turboexpander 476 based on establishment of the first pressure equilibrium state between the thermal pump 404 and the buffer chamber 456. The third valve 468 is opened to discharge the further portion of the pressurized gas, until a second pressure equilibrium state is established between the fluid source 402 and the inlet 494 of the turboexpander 476. This process of receiving the first fluid in the first channel of the thermal pump, heating the first fluid to generate the pressurized gas, and discharging of the pressurized gas is performed sequentially in each thermal pump among the plurality of the thermal pumps.

In one embodiment, the first channels 410, 412, 414 of the corresponding thermal pumps 404, 406, 408 receive the first fluid based on a predefined temperature of the thermal pumps 404, 406, 408. The first channels 410, 412, 414 of the corresponding thermal pumps 404, 406, 408 receives the first fluid from the fluid source 402 until the temperature equilibrium state is established between the thermal pumps 404, 406, 408 and the fluid source 402 before starting circulation of the second fluid through the second channels 424, 426, 428 for heating the first fluid. Similarly, opening of the second valves 430, 432, 434 for circulating the second fluid for heating the first fluid in the thermal pumps 404, 406, 408 may be based on closure of the first valve 418, 420, 422 and the establishment of the temperature equilibrium state between the thermal pumps 404, 406, 408 and the fluid source 402. The circulation of the second fluid through the second channels 424, 426, 428 of the thermal pumps 404, 406 408 is stopped when the pressure of the pressurized gas within the thermal pumps 404, 406 and 408 reaches the predefined pressure.

Further, the plurality of thermal pumps 404, 406, 408 are coupled to the buffer chamber 456 through the corresponding check valves 448, 450, 452 (may also be referred to as "first discharge valve"), and corresponding third channels 442, 444, 446. The check valves 448, 450, 452 are unidirectional valves and permit flow of the pressurized gas to the buffer chamber 456 based on the first pressure equilibrium state. The timing for opening the check valves 448, 450, 452 may be based on the pressure of the thermal pumps 404, 406, 408. The check valves 448, 450, 452 may be opened sequentially to discharge a portion of the pressurized gas from the pumps 404, 406, 408 to the buffer chamber 456. In one embodiment of the invention, the check valve 448 corresponding to the first thermal pump 404 may be opened first for discharging the portion of the pressurized gas to the buffer chamber 456 and the check valves 450, 452 corresponding to the other thermal pumps 406, 408 may be closed at that instant. Similarly, when the check valve 450 corresponding to the second thermal pump 406 is opened for discharging the pressurized gas to the buffer chamber 456, the other check valves 448, 452 of the corresponding thermal pumps 404 and 408 are closed. In other words, if any one of the check valve is opened for discharging the portion of the pressurized gas to the buffer chamber 456, the remaining check valves will be in a closed state. The check valves 448, 450, 452 are closed to stop the discharge of the portion of the pressurized gas to the buffer chamber 456 when the pressure within the corresponding thermal pumps falls below a predefined pressure level. The buffer chamber 456 is used to store the portion of the pressurized gas and also feed the pressurized gas to the heat exchanger 460 at a constant flow rate through a valve 458. In such an embodiment, the constant flow rate of the pressurized gas from the buffer chamber 456 to the heat exchanger is maintained by using a mass flow meter (not illustrated in FIG. 4.).

The turboexpander 476 is coupled to the plurality of thermal pumps 404, 406, 408 via the corresponding third valves 468, 470, 472. Specifically, the third valves 468, 470, 472 are coupled respectively to the corresponding fourth channels 462, 464 and 466. The fourth channels 464, 464, 466 are coupled via the gas manifold 474 to the turboexpander 476. Additionally, the turboexpander 476 is coupled to the fluid source 402 via the channel 480 for discharging the expanded fluid to the fluid source 402. The turboexpander is also coupled to the generator 478 for generating electric power. After closure of the check valves 448, 450, 452, and establishment of the first pressure equilibrium state between the thermal pumps 404, 406, 408 and the buffer chamber 456, the third valves 468, 470, 472 are opened to feed the further portion of the pressurized gas within the corresponding thermal pumps 404, 406, 408 to the turboexpander 476 via corresponding fourth channels 462, 464, 466. The third valves 468, 470, 472 are closed to stop the discharge of the further portion of pressurized gas from the thermal pumps 404, 406, 408 to the turboexpander 476 upon attaining a second pressure equilibrium state between the fluid source 402 and the inlet 494 of the turboexpander 476. The third valves 468, 470, 472 may also be opened sequentially. For example, when the third valve 468 corresponding to the first thermal pump 404 is opened for discharging the further portion of the pressurized gas, the other third valves 470, 472 corresponding to the thermal pumps 406 and 408 are closed.

The fluid source 402 receives the expanded fluid from the turboexpander 476 through the channel 480. The fluid source 402 may condense the fluid before feeding the condensed first fluid to the thermal pumps 404, 406, 408.

The pump 484 is coupled to the fluid source 402, and the buffer chamber 456. The pump 484 receives a portion of the first fluid from the fluid source 402 from the fluid pump 403 via a channel 482 and controlled by a valve 483. The pump 484 is configured to pressurize the portion of the first fluid. A valve 490 coupled to the compression device 484, controls discharge of a pressurized portion of the first fluid from the compression device 484 to the buffer chamber 456 through a channel 486. In such an embodiment, the pressurized portion of the first fluid is a gaseous medium. In another embodiment, the valve 490 controls discharge of a pressurized portion of the first fluid from the pump 484 to the heat exchanger 460 through a channel 492. In such an embodiment, the pressurized portion of the first fluid is a liquid medium. As discussed previously, the pump 484 is operated during certain operating conditions such as startups, shutdowns and transients condition of the system 400.

Figure 5:
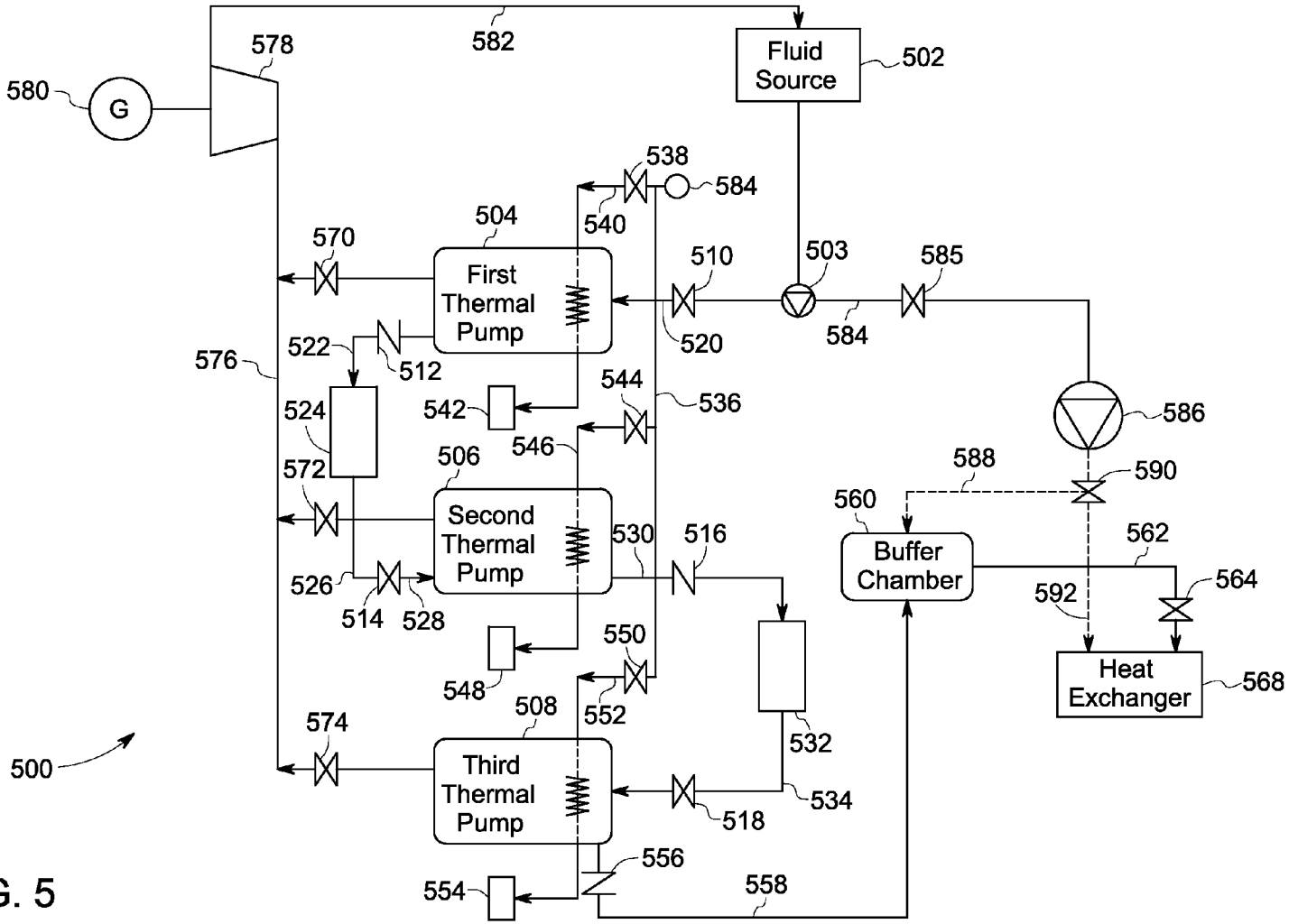
FIG. 5 is a schematic diagram of a system having a plurality of thermal pumps disposed in a series arrangement in accordance with an exemplary embodiment of the system.

FIG. 5 is a schematic diagram of another embodiment of a system 500 having a plurality of thermal pumps 504, 506, and 508 disposed in a series arrangement. In one embodiment, the system 500 includes a fluid source 502, the plurality of thermal pumps 504, 506, 508, a buffer chamber 560, a turboexpander 578, and a generator 580. Additionally, the system 500 includes a pump 586, (herein also referred to generically as a "compression device") and a heat exchanger 568. The number of the thermal pumps may vary depending on the application.

Similar to the previous embodiments, the system 500 may include a temperature sensor and a pressure sensor in each of the thermal pumps 504, 506, 508, the fluid source 502 for sensing the temperature and pressure of each of the thermal pumps 504, 506, 508 and the fluid source 502. The system may further include a pressure sensor in the buffer chamber 560 for sensing the pressure in the buffer chamber 560. Further, the system 500 may include one or more sensors for sensing a medium of the pressurized portion of the first fluid coming fed from the pump/compression device 586. Also, there may be one or more sensors to determine the operating conditions of the system 500 for determining the need for initiating the pump/compression device 586. In such an embodiment, the system 500 may further includes a control unit for controlling the respective valves and check valves based on the various conditions appropriate for the valves and check valves. The control unit may receive the signals from the temperature sensor, the pressure sensor, and the one or more sensors for controlling the respective valves, and check valves of the thermal pumps 504, 506, 508 for allowing the flow of gases or liquid or first fluid, or second fluid based on the corresponding conditions. Further, a by-pass channel arrangement discussed with reference to the previous embodiment is also equally applicable to the illustrated embodiment. The sensor arrangements and the control unit are not illustrated in FIG. 5, to keep the description of the system 500 simple, and should not be considered as a limitation of the system 500.

In the illustrated embodiment, the fluid source 502 is coupled to first thermal pump 504 and to a turboexpander 578 via a channel 582 of the turboexpander 578. The fluid source 502 feeds a first fluid to the first thermal pump 504 using a fluid pump 503, via a first valve 510 to a first channel 520 of the first thermal pump 504. The first valve 510 is closed to stop feeding of the first fluid when a temperature equilibrium state is established between the thermal pump 504 and the fluid source 502.

The second valves 538, 544, 550 are used to control flow of a second fluid from the turboexpander to respective thermal pumps 504, 506, 508 through a second channel manifold 536. The second fluid may be received from a second fluid source 584. After closure of the first valve 510 corresponding to the first thermal pump 504, the second valve 538 corresponding to the first thermal pump 504, opens for circulation of the second fluid in a heat exchange relationship with the first fluid, for heating the first fluid. The first fluid is heated to generate a pressurized gas. The second valve 538 is closed to stop the circulation of the second fluid when the pressurized gas within the first thermal pump 504 reaches a predefined pressure. A portion of the pressurized gas is discharged from the first thermal pump 504 into the second thermal pump 506 through the check valve 512. The check valve 512 discharges the portion of the pressurized gas to the second thermal pump 506 until a first pressure equilibrium state is established between the first thermal pump 504 and the second thermal pump 506. The pressurized gas discharged from the first thermal pump 504 may be cooled via a first cooling unit 524 before feeding to the second thermal pump 506. The cooling unit 524 is used to reduce the temperature of the portion of pressurized gas to maintain the temperature to be around the temperature of the first fluid entering the first thermal pump 504. The third valve 570 corresponding to the first thermal pump 504 is opened for discharging a further portion of pressurized gas from the first thermal pump 504 into the turboexpander 578 until a second pressure equilibrium state is established between the fluid source 502 and an inlet 576 of the turboexpander 578. Upon discharging the further portion of the pressurized gas from the first thermal pump 504 to the turboexpander 578, the third valve 570 corresponding to the first thermal pump 504 is closed. The second thermal pump 506 receives the portion of the pressurized gas from the first thermal pump 504 when the first valve 514 corresponding to the second thermal pump 506 is opened. The process is repeated for the second and third thermal pumps 506, 508 similar to the first thermal pump 504.

In one embodiment, the second fluid circulated in the second channels 540, 546 and 552, are discharged to condensers 542, 548, 554 respectively. In another embodiment, the second fluid circulated in the second channels 540, 546 and 552 may be discharged to the first fluid source 502.

The cooling units 524, 532 are used to reduce the temperature of the portion of pressurized gas exiting from the corresponding thermal pumps to maintain the temperature to be around the temperature of the first fluid entering the thermal pumps.

This process of receiving the pressurized gas, circulating the second fluid, discharging the portion of the pressurized gas, and discharging the further portion of the pressurized gas occurs sequentially in the second thermal pump 506 and third thermal pump 508. The third thermal pump 508 discharges the portion of pressurized gas to the buffer chamber 560 until the first pressure equilibrium state is established between the third thermal pump 508 and the buffer chamber 560. The further portion of the pressurized gas may be discharged from the third thermal pump 508 to the turboexpander 578 until the second pressure equilibrium state is established between the fluid source 502 and the inlet 576 of the turboexpander 578. The pressure of the generated gas is increased at each thermal pump 504, 506, 508 during the sequential operation of the entire system 500. In one embodiment, the pressure of the generated gas may be at about 8 bars within the first thermal pump 504, and the pressure may be at about 6 bars when the gas is received at inlet of the second thermal pump 506. In the second thermal pump 506, the pressure may be raised to about 14 bars and then discharged to the third thermal pump 508. The pressure of the gas reaching inlet of the third thermal pump 508 may be about 12 bars and then the pressure may be raised from 12 bars to 20 bars within the third thermal pump 508.

The further portion of the gas from each thermal pump 504, 506, 508 may be expanded via the turboexpander 578. In certain embodiments, the further portions of the gases are discharged sequentially from the thermal pumps 504, 506, 508 via the corresponding third valves 570, 572, 574 to the turboexpander 578 until a second pressure equilibrium state is established between the fluid source 502 and the inlet 576 of the turboexpander 578.

In the illustrated embodiment, when the first valve 510 corresponding to the first thermal pump 504 is opened for feeding the first fluid, the second valve 538, the check valve 512, and the third valve 570 corresponding to the first thermal pump 504 are closed. When the second valve 538 is opened for circulation of the second fluid, the first valve 510, the check valve 512, and the third valve 570 of the first thermal pump 504 are closed. Further, when the check valve 512 is opened for discharging the portion of the pressurized gas to the second thermal pump 506, the first valve 510, the second valve 538 and the third valve 570 corresponding to the first thermal pump 504 are closed. Similarly, when the third valve 570 is opened for discharging the further portion of the pressurized gas from the first thermal pump 504, the first and second valves 510, 538, and the check valve 512 are closed. The second valve 544 corresponding to the second thermal pump 506 is opened for circulating the second fluid for further raising the pressure of the received gas. When the check valve 516 corresponding to the second thermal pump 506 is opened for discharging the portion of the pressurized gas to the third thermal pump 508, the first and second valves 514, 544 corresponding to the second thermal pump 506 are closed. In one embodiment, the first valve 510 corresponding to the first thermal pump 504 is opened for feeding the first fluid to the first thermal pump 504, and the first valve 518 corresponding to the third thermal pump 508 is opened for feeding the pressurized gas to the third thermal pump 508. At this instant, the valves 538, 570 and check valve 512 corresponding to the first thermal pump 504 are closed. When the third valve 572 corresponding to the second thermal pump 506 is opened for discharging the further portion of the pressurized gas, the valves 514, 544 and check valve 516 associated with the second thermal pump 506 are closed. The second valves 538, 550 corresponding to the first thermal pump 504 and the third thermal pump 508 respectively are opened for circulating the second fluid for generating the pressurized gas. At this instant, the first valves 510, 518, the check valves 512, 556, and the third valves 570, 574 corresponding to the first thermal pump 504 and the third thermal pump 508 are closed. This process of receiving, circulating and discharging are performed in each thermal pump in a predefined sequence.

In illustrated embodiment, a valve 564 controls flow of the pressurized gas from the buffer chamber to the heat exchanger 568 through a valve 564. The heat exchanger 568 is used to further heat the pressurized gas. The turboexpander 578 is coupled to the generator 580, and further coupled to the plurality of thermal pumps 504, 506, 508 through the corresponding third valves 570, 572, and 574. The turboexpander 578 receives the further portion of the pressurized gas from the thermal pumps 504, 506, 508 through the inlet 576 of the turboexpander. The turboexpander 578 expands the received further portion of the pressurized gas from the thermal pumps and drives the generator 580 to generate electric power. The expanded gas is fed from the turboexpander 578 to the fluid source 502 through the channel 582.

The pump 586 is coupled to the fluid source 502 via the fluid pump 503, the channel 584. The pump 586 is used to pressurize the portion of the first fluid received from the first fluid source 502, through a valve 585. A valve 590 coupled to the compression device 586, controls discharge of a pressurized portion of the first fluid from the compression device 586 to the buffer chamber 560 through a channel 588. In such an embodiment, the pressurized first fluid is a gaseous medium. The valve 590 coupled to the pump 586, controls discharge of a pressurized portion of the first fluid from the pump 586 to the heat exchanger 568 through a channel 592. In such an embodiment, the pressurized fluid is a liquid medium. The pump 586 is operated during certain operating conditions such as start-up, shut-down, and transients condition of the system 500.

The embodiments of the present invention increases the efficiency of a power plant by utilization less electric power for driving one or more components of the power plant. The turboexpander may significantly improve the thermal pump's efficiency. The thermal pump also acts as a recuperator, replacing the requirement of large heat exchangers for preheating the fluid entering the boiler or evaporator.

The invention claimed is:

1. A system for generating electric power, comprising:

a main turboexpander;

a condenser coupled to the main turboexpander, for condensing a gas fed from the main turboexpander, to produce a condensed liquid;

a thermal pump coupled to the condenser via a liquid pump, wherein the thermal pump comprises:

a first channel for receiving the condensed liquid from the condenser through a first valve;

a second channel to circulate a portion of the gas from the main turboexpander through a second valve, in heat exchange relationship with the condensed liquid to vaporize the condensed liquid, at a constant volume of the condensed liquid and generate a pressurized gas;

a third channel for discharging a portion of the pressurized gas to a buffer chamber through a check valve; and a fourth channel for discharging a further portion of the pressurized gas through a third valve;

an auxiliary turboexpander coupled to the thermal pump via a fourth channel for receiving and expanding the further portion of the pressurized gas; and a first generator coupled to the auxiliary turboexpander, for generating electric power.

2. The system of claim 1, further comprising a heat exchanger coupled to the buffer chamber, for heating the portion of the pressurized gas from the buffer chamber.

3. The system of claim 2, further comprising a pump coupled to the liquid pump, for receiving a portion of the condensed liquid, pressurizing the portion of the condensed liquid, and feeding a pressurized portion of the condensed liquid to the heat exchanger, wherein a heat exchanger is used to heat the pressurized portion of the condensed liquid to generate a vapor.

4. The system of claim 2, further comprising a second generator coupled to the main turboexpander, for generating electric power.

5. The system of claim 1, further comprising a plurality of sensors for sensing temperature of the thermal pump, temperature of the condenser, pressure of the thermal pump, pressure of the buffer chamber, pressure of the condenser, and pressure of the gas in an inlet of the auxiliary turboexpander.

6. The system of claim 5, further comprising a control unit communicatively coupled to the plurality of sensors, wherein the control unit is configured to control at least one of:

the first valve based on a predefined temperature of the thermal pump, and a temperature equilibrium state between the condenser and the thermal pump;

the second valve based on the temperature equilibrium state between the condenser and the thermal pump, and a predefined pressure of the thermal pump;

the check valve based on the predefined pressure in the thermal pump, and a first pressure equilibrium state between the thermal pump and the buffer chamber; and the third valve based on the first pressure equilibrium state, and a second pressure equilibrium state between the condenser and an inlet of the auxiliary turboexpander.

7. The system of claim 6, further comprising a by-pass channel provided with a fourth valve, for bypassing at least some of the further portion of the pressurized gas fed from the thermal pump, wherein the control unit is configured to control the fourth valve.

8. A system for generating electric power, comprising:

a buffer chamber;

a turboexpander;

a generator coupled to the turboexpander and configured to generate electric power; and a plurality of thermal pumps comprising a first thermal pump and a second thermal pump disposed in a series arrangement, wherein the first thermal pump is coupled to a first fluid source, a second fluid source, the second thermal pump, and to the turboexpander, wherein the first thermal pump is configured to:

receive a portion of a first fluid from the first fluid source and a portion of a second fluid from the second fluid source, circulate the portion of the second fluid in heat exchange relationship with the portion of the first fluid to heat the portion of the first fluid at a constant volume of the portion of the first fluid and generate a pressurized gas, discharge a portion of the pressurized gas to the second thermal pump until a pressure equilibrium state is established between the first thermal pump and the second thermal pump, and discharge a further portion of the pressurized gas to the turboexpander until a pressure equilibrium state is established between the first fluid source and an inlet of the turboexpander; and wherein the second thermal pump is further coupled to the buffer chamber, the turboexpander, and the second fluid source, wherein the second thermal pump is configured to:

receive a further portion of the second fluid from the second fluid source, circulate the further portion of the second fluid in heat exchange relationship with the portion of the pressurized gas to heat the portion of the pressurized gas at a constant volume of the portion of the pressurized gas and generate a heated portion of the pressurized gas, discharge a portion of the heated portion of the pressurized gas until a pressure equilibrium state is established between the second thermal pump and the buffer chamber, and discharge a further portion of the heated portion of the pressurized gas until a pressure equilibrium state is established between the first fluid source and the inlet of the turboexpander.

9. The system of claim 8, further comprising a compression device for receiving a further portion of the first fluid from the first fluid source, pressurizing the further portion of the first fluid, generating a pressurized portion of the first fluid, and feeding the pressurized portion of the first fluid to the buffer chamber, wherein the further portion of the first fluid comprises a gaseous medium.

10. The system of claim 8, further comprising a pump for receiving a further portion of the first fluid from the first fluid source, pressurizing the further portion of the first fluid, generating a pressurized portion of the first fluid, and feeding the pressurized portion of the first fluid to a heat exchanger, wherein the further portion of the first fluid comprises a liquid medium.

11. The system of claim 8, further comprising a cooling unit coupled to the first thermal pump and the second thermal pump, wherein the cooling unit is configured for cooling the portion of the pressurized gas before feeding to the second thermal pump.

12. The system of claim 8, wherein the buffer chamber is used to store the portion of the heated portion of the pressurized gas and feed the portion of the heated portion of the pressurized gas to a heat exchanger.

13. The system of claim 8, further comprising a plurality of sensors for sensing a temperature of the first thermal pump, a temperature of the second thermal pump, a temperature of the first fluid source, a temperature of the pressurized gas, a pressure of the first thermal pump, a pressure of the second thermal pump, a pressure of the buffer chamber, a pressure of the first fluid source, a pressure of the pressurized gas in the inlet of the turboexpander, and a pressure of the heated portion of the pressurized gas in the inlet of the turboexpander respectively.

14. The system of claim 13, wherein the first thermal pump comprises:

a first valve coupled to a first channel and configured to feed the portion of the first fluid through the first channel until a temperature equilibrium state is established between the first thermal pump and the first fluid source;

a second valve coupled to a second channel and configured to circulate the portion of the second fluid directly from the second fluid source through the second channel;

a check valve coupled to a third channel and configured to discharge the portion of the pressurized gas to the second thermal pump through the third channel; and a third valve coupled to a fourth channel and configured to discharge the further portion of the pressurized gas to the turboexpander through the fourth channel.

15. The system of claim 14, further comprising a control unit communicatively coupled to the plurality of sensors, the first valve, the second valve, the third valve, and the check valve, wherein the control unit is configured to control at least one of:

the first valve based on a predefined temperature of the first thermal pump and the temperature equilibrium state between the first fluid source and the first thermal pump;

the second valve based on the temperature equilibrium state between the first fluid source and the first thermal pump, and a predefined pressure of the first thermal pump;

the check valve based on the predefined pressure of the first thermal pump and the pressure equilibrium state between the first thermal pump and the second thermal pump; and the third valve based on the pressure equilibrium state between the first thermal pump, the second thermal pump, and the pressure equilibrium state between the first fluid source and the inlet of the turboexpander.

16. The system of claim 13, wherein the second thermal pump comprises:

a first valve coupled to a first channel and configured to feed the portion of the pressurized gas through the first channel until a temperature equilibrium state is established between the first thermal pump and the second thermal pump;

a second valve coupled to a second channel and configured to circulate the further portion of the second fluid directly from the second fluid source through the second channel;

a check valve coupled to a third channel and configured to discharge the portion of the heated portion of the pressurized gas to the buffer chamber through the third channel; and a third valve coupled to a fourth channel and configured to discharge the further portion of the heated portion of the pressurized gas to the turboexpander through the fourth channel.

17. The system of claim 16, further comprising a control unit communicatively coupled to the plurality of sensors, the first valve, the second valve, the third valve, and the check valve, wherein the control unit is configured to control at least one of:

the first valve based on a predefined temperature of the second thermal pump and the temperature equilibrium state between the first thermal pump and the second thermal pump;

the second valve based on the temperature equilibrium state between the first thermal pump, the second thermal pump, and a predefined pressure of the second thermal pump;

the check valve based on the predefined pressure of the second thermal pump and the pressure equilibrium state between the second thermal pump and the buffer chamber; and the third valve based on the pressure equilibrium state between the first thermal pump, the buffer chamber, and the pressure equilibrium state between the first fluid source and the inlet of the turboexpander.

18. A method for generating electric power, comprising:

receiving a portion of a first fluid from a first fluid source and a portion of a second fluid from a second fluid source, by a first thermal pump of a plurality of thermal pumps;

circulating the portion of the second fluid in heat exchange relationship with the portion of the first fluid to heat the portion of the first fluid at a constant volume of the portion of the first fluid and generate a pressurized gas;

discharging a portion of the pressurized gas from the first thermal pump to a second thermal pump of the plurality of thermal pumps, until a pressure equilibrium state is established between the first thermal pump and the second thermal pump, wherein the first thermal pump and the second thermal pump are disposed in a series arrangement;

discharging a further portion of the pressurized gas from the first thermal pump to a turboexpander until a pressure equilibrium state is established between the first fluid source and an inlet of the turboexpander;

receiving a further portion of the second fluid from the second fluid source by the second thermal pump;

circulating the further portion of the second fluid in heat exchange relationship with the portion of the pressurized gas to heat the portion of the pressurized gas at a constant volume of the portion of the pressurized gas and generate a heated portion of the pressurized gas;

discharging a portion of the heated portion of the pressurized gas from the second thermal pump to a buffer chamber until a pressure equilibrium state is established between the second thermal pump and the buffer chamber;

discharging a further portion of the heated portion of the pressurized gas from the second thermal pump to the turboexpander until a pressure equilibrium state is established between the first fluid source and the inlet of the turboexpander; and expanding at least one of the further portion of the pressurized gas and the further portion of the heated portion of the pressurized gas, in the turboexpander for driving a generator to generate electric power.

19. The method of claim 18, further comprising receiving a further portion of the first fluid from the first fluid source, pressurizing the further portion of the first fluid, generating a pressurized portion of the first fluid, and feeding the pressurized portion of the first fluid to the buffer chamber, by a compression device, wherein the further portion of the first fluid comprises a gaseous medium.

20. The method of claim 18, further comprising receiving a further portion of the first fluid from the first fluid source, pressurizing the further portion of the first fluid, generating a pressurized portion of the first fluid, and feeding the pressurized portion of the first fluid to a heat exchanger, by a pump, wherein the further portion of the first fluid comprises a liquid medium.

21. The method of claim 18, further comprising cooling the portion of the pressurized gas before feeding to the second thermal pump, by a cooling unit, wherein the cooling unit is coupled to the first thermal pump and the second thermal pump.

22. The method of claim 18, further comprising storing the portion of the heated portion of the pressurized gas in the buffer chamber and feeding the portion of the heated portion of the pressurized gas to a heat exchanger.

23. The method of claim 18, further comprising sensing temperature of the first thermal pump, a temperature of the second thermal pump, a temperature of the first fluid source, a temperature of the pressurized gas, a pressure of the first thermal pump, pressure of the second thermal pump, a pressure of the buffer chamber, a pressure of the first fluid source, a pressure of the pressurized gas in the inlet of the turboexpander, and a pressure of the heated portion of the pressurized gas in the inlet of the turboexpander, by using a plurality of sensors respectively.

24. The method of claim 23, further comprising controlling at least one of:

a first valve based on a predefined temperature of the first thermal pump and a temperature equilibrium state between the first fluid source and the first thermal pump, to feed the portion of the pressurized gas through a first channel;

a second valve based on the temperature equilibrium state between the first fluid source and the first thermal pump and a predefined pressure of the first thermal pump, to circulate the portion of the second fluid directly from the second fluid source through a second channel;

a check valve based on the predefined pressure in the first thermal pump and the pressure equilibrium state between the first thermal pump and the second thermal pump, to discharge the portion of the pressurized gas to the second thermal pump through a third channel; and a third valve based on the pressure equilibrium state between the first thermal pump and the second thermal pump and the pressure equilibrium state between the first fluid source and the inlet of the turboexpander, to discharge the further portion of the pressurized gas to the turboexpander through a fourth channel.

25. The method of claim 23, further comprising controlling at least one of:

a first valve based on a predefined temperature of the second thermal pump and a temperature equilibrium state between the first thermal pump and the second thermal pump, to feed the portion of the pressurized gas through a first channel;

a second valve based on the temperature equilibrium state between the first thermal pump and the second thermal pump and a predefined pressure of the second thermal pump, to circulate the further portion of the second fluid directly from the second fluid source through a second channel;

a check valve based on the predefined pressure in the second thermal pump and the pressure equilibrium state between the second thermal pump and the buffer chamber, to discharge the portion of the heated portion of the pressurized gas to the buffer chamber through a third channel; and a third valve based on the pressure equilibrium state between the first thermal pump and the buffer chamber and the pressure equilibrium state between the first fluid source and the inlet of the turboexpander, to discharge the further portion of the heated portion of the pressurized gas to the turboexpander through a fourth channel.

* * * * *